US007730911B2

(12) United States Patent
Pericard

(10) Patent No.: US 7,730,911 B2
(45) Date of Patent: Jun. 8, 2010

(54) MEANS AND METHOD FOR FILLING BAG-ON-VALVE AEROSOL BARRIER PACKS

(75) Inventor: Louis Pericard, Hattersheim (DE)

(73) Assignee: Precision Valve Corporation, Yonkers, NY (US)

( * ) Notice: Subject to any disclaimer, the term of this patent is extended or adjusted under 35 U.S.C. 154(b) by 322 days.

(21) Appl. No.: 11/519,729

(22) Filed: Sep. 12, 2006

(65) Prior Publication Data

US 2007/0006938 A1 Jan. 11, 2007

Related U.S. Application Data

(62) Division of application No. 10/616,665, filed on Jul. 10, 2003, now Pat. No. 7,124,788.

(51) Int. Cl.
*B65B 31/00* (2006.01)
*B65B 7/00* (2006.01)

(52) U.S. Cl. ..... 141/20; 141/3; 141/372; 53/470

(58) Field of Classification Search ..... 141/2, 141/3, 20, 18, 372; 222/95, 402.16, 105; 53/469, 470, 467
See application file for complete search history.

(56) References Cited

U.S. PATENT DOCUMENTS 2,975,575 A * 3/1961 Nalbach et al. ..... 53/351
3,176,727 A 4/1965 Rousseau
3,179,132 A 4/1965 Focht
3,180,374 A 4/1965 Muller ..... 141/20
3,234,707 A * 2/1966 Weston ..... 141/20
3,348,587 A 10/1967 Grothoff
3,454,198 A 7/1969 Flynn ..... 222/402.22
3,459,244 A 8/1969 Riccio
3,528,461 A 9/1970 Grothoff
3,550,649 A 12/1970 Meshberg
3,568,888 A 3/1971 Baldoni et al.
3,593,889 A 7/1971 Prussin et al.
3,612,361 A 10/1971 Ewald et al.

(Continued)

FOREIGN PATENT DOCUMENTS

DE 10115452 A1 * 9/2002

(Continued)

*Primary Examiner*—Timothy L Maust
(74) *Attorney, Agent, or Firm*—Ohlandt, Greeley, Ruggiero & Perle, L.L.P.

(57) ABSTRACT

A bag-on-valve aerosol valve system in a container. Propellant is pressure filled around the valve stem, outwardly over the stem gasket and down into the container space outside the bag. Product is filled through the valve stem into the bag. The valve stem has an exterior intermediate frusto-conical annular surface and the valve housing has an interior frusto-conical annular surface, with both surfaces engaging in annular sealing contact to block propellant access to the bag when the valve stem is deeply depressed to a first predetermined position for propellant pressure filling. A stem exterior surface indent interacts with radially-biased spring-loaded slides to lock the stem in a second less depressed predetermined position for product filling through the stem down into the bag. The propellant and product may be pressure filled in either order using essentially conventional pressure filing equipment, after the valve is mounted on the container and the bag is mounted on the valve.

6 Claims, 6 Drawing Sheets

U.S. PATENT DOCUMENTS

| | | | | | |
|---|---|---|---|---|---|
| 3,642,035 | A | | 2/1972 | Marand | |
| 3,690,515 | A | | 9/1972 | Ewald | |
| 3,745,741 | A | * | 7/1973 | Cunningham et al. | 53/88 |
| 3,806,005 | A | | 4/1974 | Prussin et al. | 222/402.16 |
| 3,823,849 | A | | 7/1974 | Ruscitti | 222/96 |
| 3,995,666 | A | * | 12/1976 | Michaels | 141/20 |
| 4,015,752 | A | | 4/1977 | Meuresch et al. | 222/402.16 |
| 4,015,757 | A | | 4/1977 | Meuresch et al. | 222/402.16 |
| 4,148,419 | A | | 4/1979 | MacNair | 222/189 |
| 4,220,265 | A | * | 9/1980 | Shay | 141/20 |
| 4,441,634 | A | | 4/1984 | Meshberg | |
| 4,615,470 | A | | 10/1986 | Hyland et al. | 222/402.16 |
| 4,896,799 | A | | 1/1990 | Giuffredi | 222/321 |
| 5,211,316 | A | | 5/1993 | Adalberto et al. | |
| 5,237,797 | A | | 8/1993 | Valet | 53/420 |
| 5,261,573 | A | | 11/1993 | Jouillat et al. | 222/321 |
| 5,505,039 | A | | 4/1996 | Maier | |
| 5,630,530 | A | | 5/1997 | Geier et al. | 222/95 |
| RE35,683 | E | * | 12/1997 | Varlet | 53/471 |
| 5,730,326 | A | | 3/1998 | Kaeser | |
| 6,039,306 | A | | 3/2000 | Pericard | |
| 6,085,945 | A | | 7/2000 | Fransen | |
| 6,299,024 | B1 | | 10/2001 | Corba | 222/145.5 |
| 6,394,364 | B1 | | 5/2002 | Abplanalp | 222/145.1 |
| 6,698,620 | B2 | * | 3/2004 | Ogata et al. | 141/20 |
| 6,776,186 | B2 | * | 8/2004 | Swinford | 137/614 |
| 6,789,702 | B2 | | 9/2004 | O'Connor et al. | 222/96 |
| 6,874,544 | B2 | * | 4/2005 | O'Connor et al. | 141/20 |

FOREIGN PATENT DOCUMENTS

| | | | |
|---|---|---|---|
| EP | 1238911 | | 9/2002 |
| FR | 2692569 | | 12/1993 |
| GB | 1212374 | | 11/1970 |
| GB | 2040002 | | 8/1980 |
| JP | 59-113398 | | 6/1984 |
| JP | 401171666 A | * | 7/1989 |
| WO | WO 01/17689 A1 | | 3/2001 |

* cited by examiner

MEANS AND METHOD FOR FILLING BAG-ON-VALVE AEROSOL BARRIER PACKS

This application is a division of U.S. application Ser. No. 10/616,665 filed Jul. 10, 2003, which issued on Oct. 24, 2006 as U.S. Pat. No. 7,124,788. Applicant claims the benefit of the prior U.S. application.

FIELD OF THE INVENTION

The present invention relates to the filling of propellant and product into aerosol containers. More specifically, the invention relates to the filling of such containers of the bag-on-valve barrier pack type wherein a bag within the container is intended to hold the product to be dispensed and the remainder of the container is intended to hold the propellant.

BACKGROUND OF THE INVENTION

Aerosol containers of the barrier pack type include the well-known piston-in-can, and bag-in-can, embodiments. In one form of the latter, to which the present invention is directed, a flexible bag within the can may have its open end sealingly connected to the valve housing of the aerosol valve. Such embodiments are referred to as bag-on-valve systems. The product to be dispensed from the aerosol container commonly is filled into the flexible bag within the container and a liquified propellant or compressed gas is filled into the aerosol container outside of the bag between the bag outer wall and the inner wall of the can. When the aerosol valve is actuated, the propellant acts against the outer wall of the bag to force the product being dispensed out the aerosol valve to the environment outside the can. When the valve actuation ceases, of course, the product dispensing ceases.

Heretofore, the filling of the propellant into the container outside of the bag usually has been accomplished by filling propellant under the mounting cup or through the bottom of the container or by other complex schemes and structure. Such forms of propellant filling may require special and expensive filling equipment not owned by many commercial fillers who generally do own conventional pressure filling equipment to fill aerosol containers that do not include bag-on-valve systems. Such prior art forms of propellant filling can also be slow. In addition, prior art bag-on-valve systems do not generally permit product and propellant pressure filling to separately occur after the valve has been fixed to the container, such that the product and propellant cannot mix and the product filling cannot be shut off by imprecise stem positioning during product filling.

SUMMARY OF THE INVENTION

The present invention is intended to provide a simple and efficient means to pressure fill, in either order, propellant into the container outside of the bag and product (for example, a gel) into the bag in the container. Both operations are carried out by using mostly conventional pressure filling equipment after the bag has been sealingly mounted onto the housing or housing extension of the aerosol valve, or onto a fixture such as a wedge attached to the housing or housing extension. In this application, use of the term valve housing in connection with attachment of the bag shall also be taken to include attachment to such housing extension or fixture.

The propellant is filled from the filling head around the outside of the valve stem, between the valve stem and the mounting cup opening for the valve stem, over the top of the aerosol valve gasket, between the outside of the valve housing and the mounting cup, and down into the aerosol container outside of the bag mounted on the valve housing. The valve stem is depressed during this propellant filling operation so as to allow the aerosol valve gasket to bend to allow the propellant to flow above the gasket. At the same time, the filling head plugs the top dispensing opening of the valve stem so that the propellant only fills around the outside of the valve stem as described above.

The propellant filling operation as described above is generally well known for aerosol systems where there is no separate product bag already connected to the valve housing. The presence of such a connected product bag creates a serious impediment to such propellant filing in that the propellant passing around the stem also can pass between the bent valve gasket and the adjacent valve stem into the interior of the valve housing between the housing inner wall and the stem outer wall. This propellant would then have open access down into the product bag. This of course is highly disadvantageous in a bag-on-valve barrier pack wherein the product and propellant are to be maintained separate from one another.

A first aspect of the present invention allows the above-described propellant pressure filling to be used in a bag-on-valve system when the bag is already connected to the valve housing and the valve is fixed to the container. This is accomplished by providing an annular interior surface on the valve housing, for example a frusto-conical surface, and an annular exterior surface on the valve stem, for example a frusto-conical surface, the two said surfaces sealingly contacting each other only when the downward engagement pressure of the propellant filling head pushes the valve stem down the full distance to make such contact upon propellant filling. This downward pressure of the filling head will exceed the normal actuating pressure of the valve user in a downward or sideward direction on the stem to cause valve actuation and dispensing. Thus, the said respective frusto-conical surfaces of the stem and housing will not contact and seal against each other during normal valve actuation, since such contact and sealing during actuation would prevent product exiting the product bag into the valve housing and out the valve. The said respective frusto-conical surfaces of the stem and housing, upon sealing against each other during propellant filling, block propellant during filling entering into the product bag. Stem and housing surface profiles other than frusto-conical may be utilized as long as they effectively seal against each other to prevent propellant entering into the product bag.

In a second aspect of the present invention, the product bag in the can, sealingly connected to the valve housing, may be filled with product after (or before) the above-described propellant filling. The product filling is carried out through the dispensing conduit of the valve stem, with the valve stem being depressed a distance considerably less than during propellant filling but a sufficient amount to unseal the stem lateral orifices from the valve gasket. Product, for example a gel, flows down the center conduit of the valve stem, through the stem lateral orifices, into the valve housing interior, and down into the bag connected to the valve housing. The valve stem is held at a predetermined position of depression by a combination of a stem configuration and a novel insert adaptor configuration in the product filling head. More particularly, an annular indentation in the surface of the valve stem is utilized for engagement with spring loaded radial slides in the insert of the product filling head to maintain the position of the valve stem during filling. (Such stem indentations have been previously utilized, but for the unrelated purpose of securing actuator buttons). Without such a locking interengagement, the stem position can fluctuate under the pressure of product entering the valve stem. This fluctuation can either cause the stem to rise during product filling to partially or completely close the stem lateral orifices to prevent product filling, or may depress the stem so far as to seal the stem against the housing by the afore-described annular frusto-conical surfaces to prevent product filling down into the bag.

In a third aspect, the present invention discloses a novel method described above whereby propellant top pressure filling and product top pressure filling, in either order, are respectively carried out around the valve stem and through the valve stem into a bag-on-valve system wherein the product bag is already sealingly connected to the valve housing and the valve is already fixed to the container. The valve stem is in a first predetermined depressed position for propellant pressure filling and in a second predetermined depressed position for product pressure filling.

Other features and advantages of the present invention will be apparent from the following description, drawings and claims.

DETAILED DESCRIPTION OF EMBODIMENTS

Figure 1:
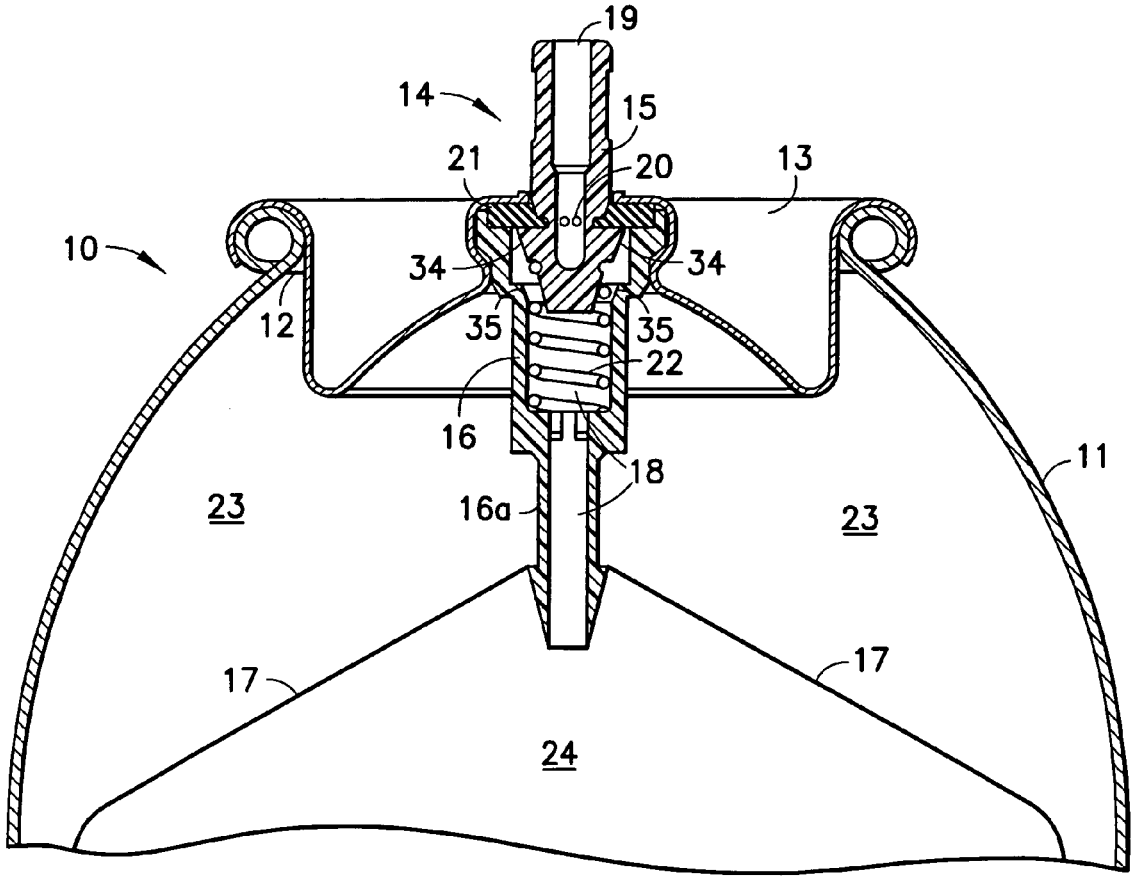
FIG. 1 is a partial axial cross-sectional view of a barrier pack, bag-on-valve, aerosol valve system of the present invention illustrating the aerosol valve in closed position.

Referring to FIG. 1, aerosol valve system 10 includes a conventional closed container or can 11 (only the top portion of which is shown) with a top circular opening 12 within which is mounted aerosol mounting cup 13. Centrally disposed within mounting cup 13 is aerosol valve 14 comprised of valve stem 15 and valve housing 16. Valve housing 16 at the extension 16*a* of its lower end has a flexible product bag 17 attached thereto in a sealingly connected manner. Flexible bag 17 may be comprised of polyethylene and/or other materials (including in laminated form) and is of well known structure. Bag 17 will contain the product to be dispensed from the aerosol container, and is a closed structure throughout except at the top of the bag where it is open only into the interior 18 of the valve housing. The bag 17 is welded all about its top opening to the outside of the lower extension 16*a* of the valve housing. The bag 17 alternatively may be welded to a wedge or other fixture at the end of lower extension 16*a*. Bag 17, only partially shown, extends down into the container to near the bottom of the container in known fashion.

Aerosol valve stem 15 includes a central dispensing channel 19 and lateral side orifices 20 which are sealed by gasket 21 when aerosol valve 14 is closed by annular gasket 21, which has a central opening. Spring 22 in the interior 18 of the valve housing 16 biases the valve stem 15 to a closed position as shown in FIG. 1 when the valve 14 is not actuated.

When propellant has been filled into aerosol container 11 into space 23 outside of bag 17, and product has been filled into the interior 24 of bag 17, the aerosol valve system is ready for use. When valve stem 15 is depressed (or moved laterally in the case of a tilt valve), gasket 21 unseals from stem lateral orifices 20. The pressure of the propellant outside the bag 17 presses inward against flexible bag 17 to force the product in the bag up through the interior 18 of valve housing 16, through lateral orifices 20 and up the stem dispensing channel 19 to the outside environment. As is known, an actuator (not shown, and of various forms) may be used to actuate valve stem 15 for dispensing. When stem 15 is no longer actuated, spring 22 forces valve stem 15 back to its position where gasket 21 again seals lateral orifices 20 to prevent further dispensing.

Figure 2:
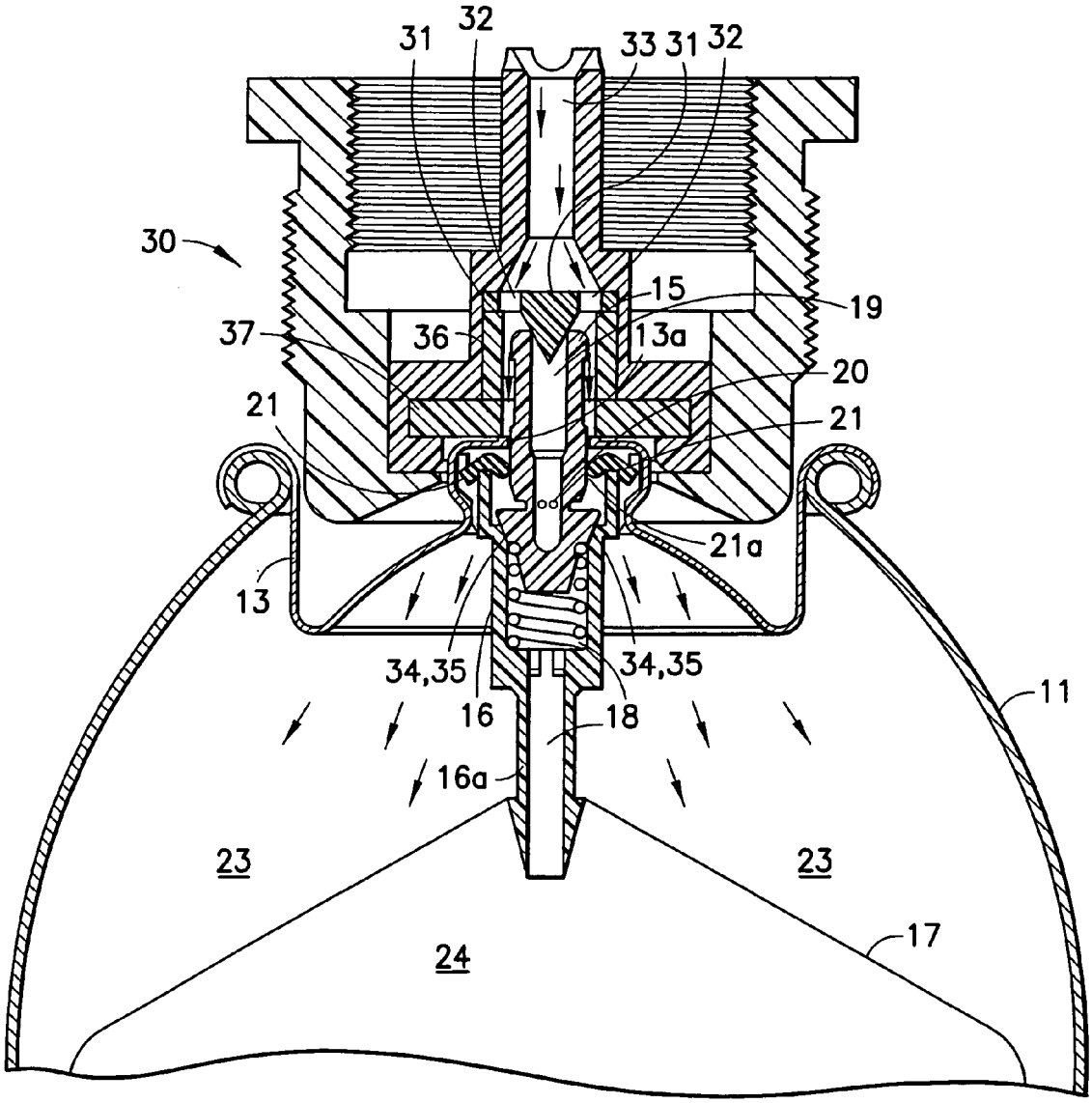
FIG. 2 is a partial axial cross-sectional view of a bag-on valve aerosol valve system of the present invention corresponding to FIG. 1, and wherein propellant is being filled into the aerosol container outside the bag by a propellant filling head.

Now turning to the first aspect of the present invention, reference is made to FIG. 2. Propellant filling head 30 is shown in filling position and is a conventional well-known apparatus. Valve stem 15 has been depressed by the filling head and plug member 31 plugs the top of stem dispensing conduit 19 to prevent propellant passing down through the conduit upon filling. Plug member 31 is an annular member with a plurality of radially outward holes 32 for filling propellant therethrough as shown by the arrows of FIG. 2. Propellant is filled in known fashion down through filling head conduit 33, through holes 32, downward along the outside surface of stem 15, through the circular opening 13*a* in the top of mounting cup 13 through which stem 15 passes, outwardly over the top of valve sealing gasket 21, downwardly along the outside of valve housing 16, and finally into container space 23 outside of bag 17. This method of filling is well known, and shown for example in U.S. Pat. Nos. 4,015,752 (Meuresch) and 4,015,757 (Meuresch), both issued Apr. 5, 1997 and incorporated herein by reference.

It will be noted that the above-described propellant filling occurs while product bag 17 is already positioned within container 11 and welded to extension 16*a* of the valve housing. It is important in the barrier pack system of the present invention that the propellant during propellant filling not enter into bag 17, which is solely for the containing of the product to be dispensed. This undesired entry would be possible with a standard valve stem 15 and valve housing 16, in that, referring to FIG. 2, propellant to be filled over the top of gasket 21 also can force its way between gasket 21 and the side of valve stem 15 at the annular area of contact 21*a* with the stem 15 of the bent down gasket 21 shown in FIG. 2. In the standard aerosol valve, the valve stem 15 does not make a sealing contact with the inner surface of the valve housing 16 during propellant filling, and thus the propellant forcing its way between bent gasket 21 and the side of valve stem 15 will pass downward through the interior 18 of valve housing 16 and downward into bag 17. This is avoided in the present invention by providing a frusto-conical surface 34 extending around an intermediate portion of the valve stem (also see FIGS. 1 and 3), and frusto-conical surface 35 extending around the valve housing 16 (also see FIG. 1). Surface 34 may for example be at an angle of twenty degrees to the vertical, and surface 35 may be at the same angle to the vertical. In the closed position of the aerosol valve (see FIG. 1), the surfaces 34 and 35 are separated from one another. Likewise, when the aerosol valve is actuated in normal dispensing operation, valve stem 15 will not be depressed sufficiently to bring surfaces 34 and 35 into sealing contact by normal actuation pressure acting against the force of spring 22. However, during propellant filling, the force of the propellant head against the valve stem 15 forces valve stem 15 to depress sufficiently such that frusto-conical surface 34 and 35 make annular plastic to plastic sealing contact with each other. Therefore no propellant being filled can pass down into the valve housing extension 16*a* into the bag 17 since surfaces 34 and 35 seal off the bag from propellant entry. A conventional propellant filling head 30 may thereby be used despite the presence of product bag 17 in the container 11. Filling head 30 also includes spacer cylinder 36 and annular gasket 37, as well known.

Figure 3:
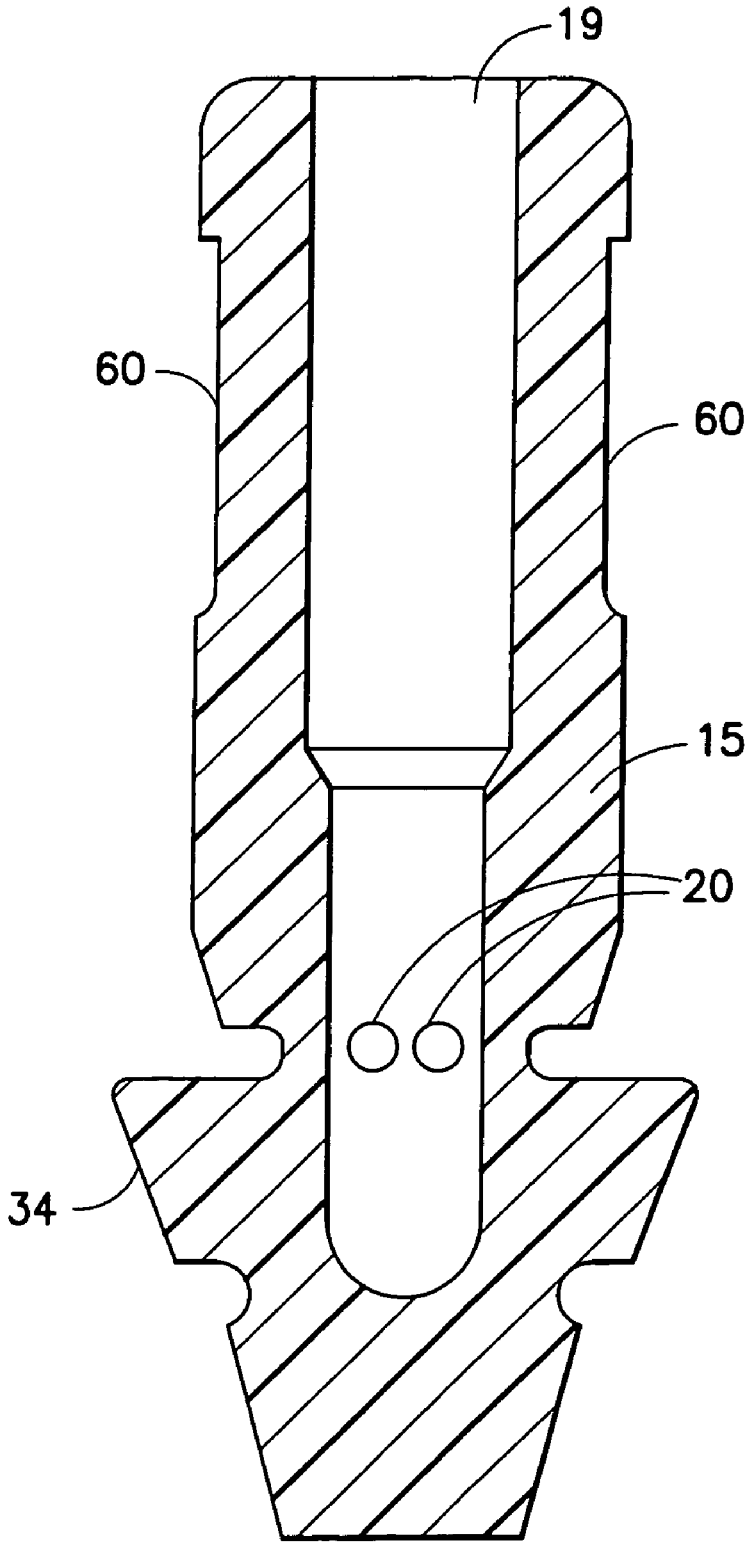
FIG. 3 is an axial cross-sectional view of an aerosol valve stem of the present invention.
Figure 4:
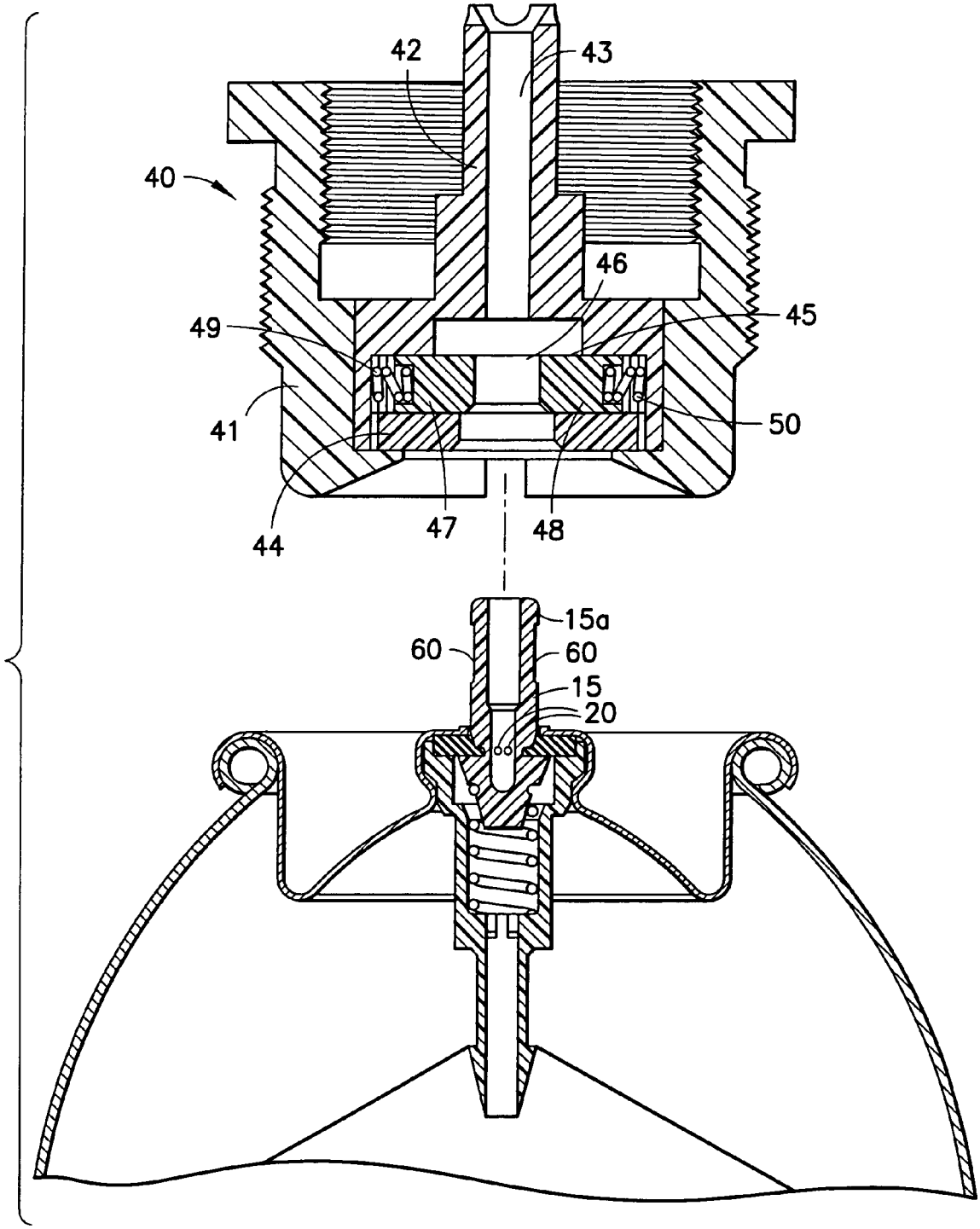
FIG. 4 is a partial axial cross-sectional view of a product filling head of the present invention positioned above and not yet engaged with the bag-on-valve aerosol valve system of FIG. 1.
Figure 5:
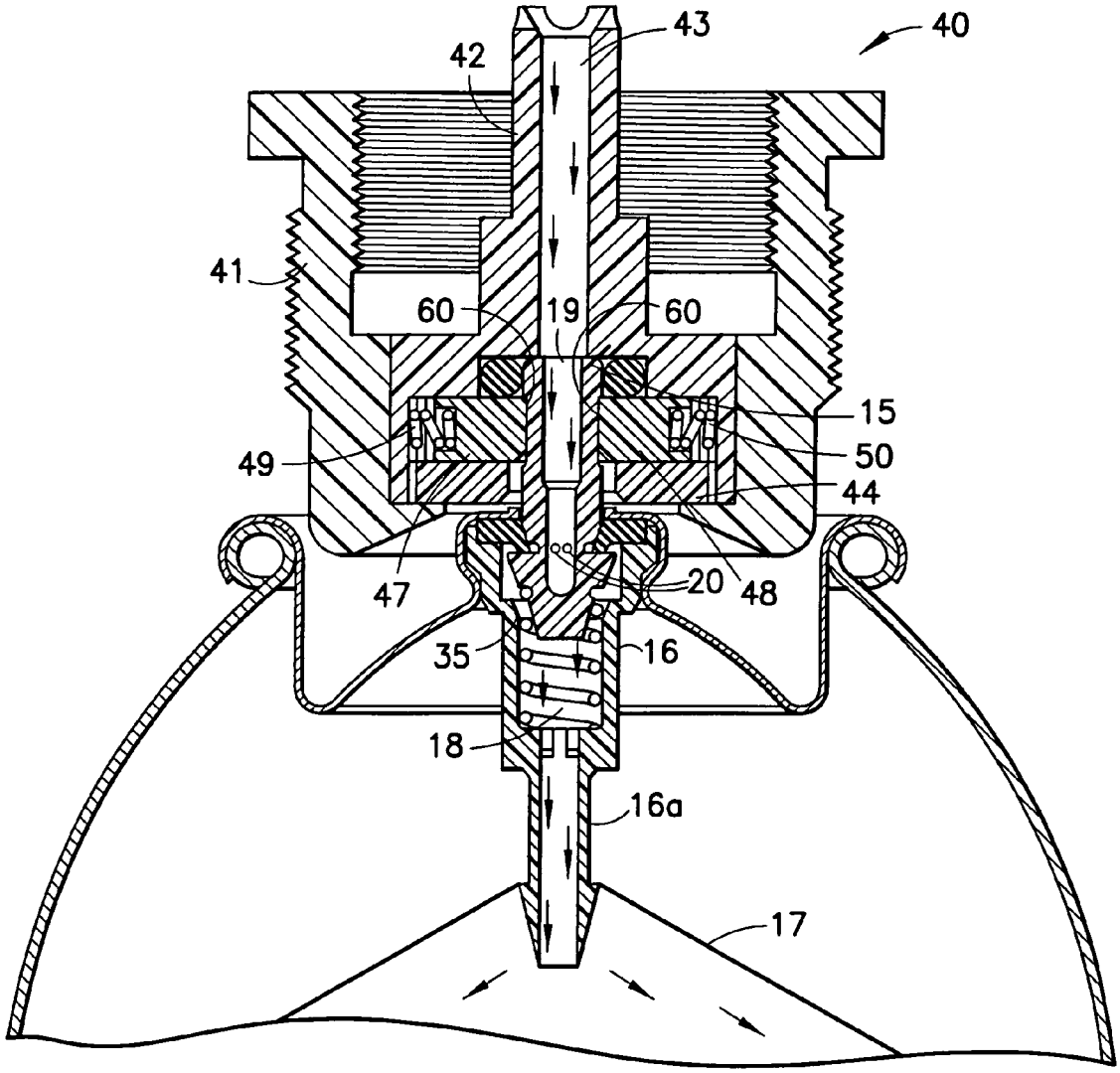
FIG. 5 is a partial axial cross-sectional view corresponding to FIG. 4 but with the product filling head engaged with the valve stem and filling product into the bag-on-valve aerosol valve system of FIG. 1.
Figure 6:
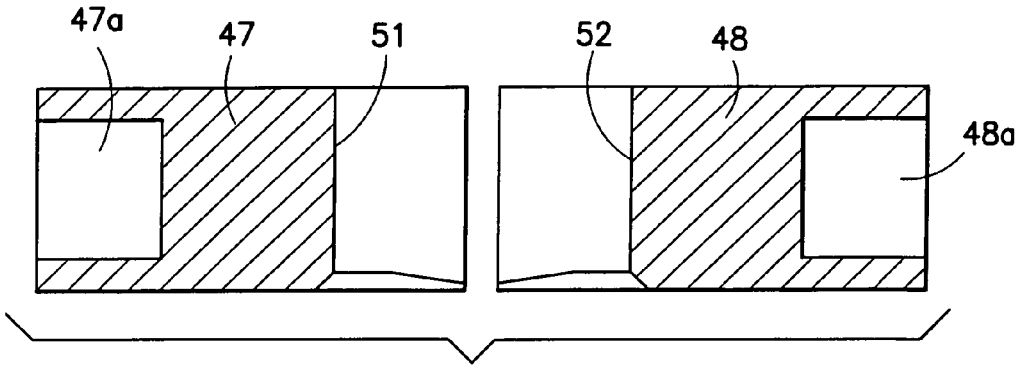
FIG. 6 is an enlarged axial cross-sectional view of slide member components of the product filling head of FIG. 5.
Figure 7:
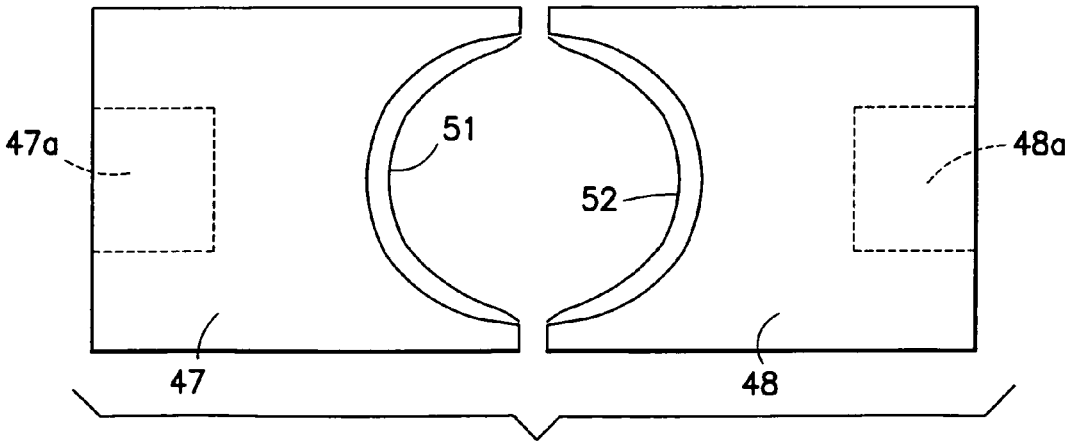
FIG. 7 is an enlarged plan view of the bottom of the slide member components of FIG. 6.

Turning to the second, product filling, aspect of the present invention, reference is made to FIGS. 3, 4 and 5. It should be understood that product filling may occur after, or before, the propellant filling operation of FIG. 2. FIG. 4 illustrates product filling head 40 before it is positioned on the aerosol valve system, and FIG. 5 illustrates product filling head 40 after it is in position for filling product into bag 17 in the can 11. Filling head 40 includes outer annular wall 41, inner annular product filling member 42 including product conduit 43, spacer cylinder 44, and product filing registration insert member 45. Member 45 is comprised of U-shaped slide guides, and within the guides at for example positions one hundred and eighty degrees apart, radial slide members 47 and 48 (also see FIGS. 6,7) that are spring loaded by springs 49 and 50 to bias the slide members 47 and 48 radially inward and slightly into opening 46. Springs 49 and 50 abut product filling member 42 on one end of each spring, the other end of each spring respectively fitting into openings 47*a* and 48*a* of slide members 47, 48. When product filling head 40 is positioned onto the aerosol valve system, the top outer portion 15*a* of stem 15 fits into opening 46 and biases the slides 47, 48 radially outward against the springs 49 and 50. Referring to FIGS. 3, 4 and 5, stem 15 also has annular indent 60 about the circumference of valve stem 15. Therefore, as the top outer portion 15*a* of stem 15 passes upwardly through opening 46, radial slides 47 and 48 snap into stem indent 60 under the force of the springs 49 and 50. Curvilinear faces 51 and 52 (see FIGS. 6,7) of slide members 47 and 48 now encircle the stem 15. At this position, as shown in FIG. 5, valve stem 15 is in a downwardly depressed position so that the lateral stem orifices 20 are no longer sealed by gasket 21. The stem 15 is locked into its precise depressed position by slides 47 and 48 locked into stem indent 60, which depressed position is sufficient to unseal stem orifices 20 but not so great as to sealingly engage stem and housing frusto-conical surfaces 34 and 35.

To now carry out product filling into bag 17, product is filled through conduit 43, stem dispensing conduit 19, stem lateral orifices 20, interior space 18 of valve housing 16, down through valve housing extension 16*a*, and into bag 17. When the product filling is completed, the product filing head 40 is removed. The precise positioning of the valve stem 15 permitted by radial slides 47, 48 and stem indent 60 not only prevents the stem 15 from being further depressed to seal surfaces 34, 35 and prevent product filling down into the bag, but also prevents the stem 15 from rising up due to filling back pressure to seal lateral orifices 20 and prevent product from entering the valve housing 16 during product filling.

In a third aspect of the present invention, it will be seen from the description above that a bag-on-valve system, with a bag already in the can and the valve fixed to the container, can therefore be top pressure filled with both propellant and product in either order. By controlling the degree of stem depression and stem sealing during the respective filing operations, and by providing first and second predetermined depressed stem positions during said operations, propellant only is filled to the can space outside the bag and product only is filled into the bag. A simple, fast and efficient filling system using conventional pressure filling equipment thereby results.

It will be appreciated by persons skilled in the act that variations and/or modifications may be made to the present invention without departing from the spirit and scope of the invention. The present embodiments are, therefore, to be considered as illustrative and not restrictive. Purely as an example, a dip tube may extend from the valve housing down into the product bag to prevent the bag "pocketing" during dispensing. It should also be understood that positional terms as used in the specification are used and intended in relation to the normal positioning shown in the drawings, and are not otherwise intended to be restrictive.

What is claimed is:

1. An apparatus for pressure filling product into a bag-on-valve aerosol valve system, the product to be filled into the bag sealingly mounted to the valve, and the valve having a valve stem with an indent in its exterior surface, the apparatus comprising:

a product filling head insert member having two spring-loaded slides, each of the spring-loaded slides being extendable into the indent in the exterior surface of the valve stem to establish a precise degree of stem depression for product filling upon insertion of the valve stem into the product filling head insert member.

2. The apparatus of claim 1, wherein the two spring-loaded slides are spaced an angular distance from each other.

3. The apparatus of claim 2, wherein the two spring-loaded slides are biased radially inwardly towards the valve stem in an interference relation, are movable radially outwardly when the valve stem is initially inserted into the product filling head insert member, and are movable inwardly under spring-bias into the indent in the exterior surface of the valve stem when the valve stem is inserted into the product filling head insert member to a desired depth.

4. The apparatus of claim 2, wherein the indent in the exterior surface of the valve stem is annular and said two spring-loaded slides have curvilinear inner faces for extending into the indent.

5. The apparatus of claim 1, wherein each of the spring-loaded slides is extendable radially inward into the indent in the exterior surface of the valve stem.

6. An apparatus for pressure filling product into a bag-on-valve aerosol valve system, the product to be filled into the bag sealingly mounted to the valve, and the valve having a valve stem with an indent in its exterior surface, the apparatus comprising:

a product filling head insert member having two spring-loaded slides, each of the spring-loaded slides being extendable into the indent in the exterior surface of the valve stem to establish a precise degree of stem depression for product filling upon insertion of the valve stem into the product filling head insert member, wherein the two spring-loaded slides are spaced an angular distance from each other, and wherein the two spring-loaded slides are biased radially inwardly towards the valve stem in an interference relation, are movable radially outwardly when the valve stem is initially inserted into the product filling head insert member, and are movable inwardly under spring-bias into the indent in the exterior surface of the valve stem when the valve stem is inserted into the product filling head insert member to a desired depth.

* * * * *